US008702458B2

(12) United States Patent
Preston

(10) Patent No.: US 8,702,458 B2
(45) Date of Patent: Apr. 22, 2014

(54) POWERED WATER SPORTS BOARD

(76) Inventor: Christopher Preston, Mooloolaba (AU)

( * ) Notice: Subject to any disclaimer, the term of this patent is extended or adjusted under 35 U.S.C. 154(b) by 0 days.

(21) Appl. No.: 13/500,353

(22) PCT Filed: Oct. 27, 2010

(86) PCT No.: PCT/AU2010/001437
§ 371 (c)(1),
(2), (4) Date: Apr. 5, 2012

(87) PCT Pub. No.: WO2011/050410
PCT Pub. Date: May 5, 2011

(65) Prior Publication Data
US 2012/0196494 A1 Aug. 2, 2012

(30) Foreign Application Priority Data
Oct. 27, 2009 (AU) ..... 2009905271

(51) Int. Cl.
*B63H 1/16* (2006.01)

(52) U.S. Cl.
USPC ..... 440/67; 440/66; 441/74; 114/55.56

(58) Field of Classification Search
USPC ..... 114/55.56; 441/74; 440/67, 66
See application file for complete search history.

(56) References Cited

U.S. PATENT DOCUMENTS

| | | | | |
|---|---|---|---|---|
| 3,144,849 | A * | 8/1964 | Maser | 114/55.51 |
| 3,405,677 | A | 10/1968 | Smith | |
| 4,304,558 | A * | 12/1981 | Holtermann | 440/67 |
| 4,358,280 | A * | 11/1982 | Jeanson et al. | 440/61 R |
| 5,017,166 | A * | 5/1991 | Chang | 440/7 |
| 5,470,262 | A * | 11/1995 | Bustillo, Sr. | 440/72 |
| 5,501,622 | A * | 3/1996 | Phelan | 440/71 |
| 6,152,793 | A * | 11/2000 | Gongwer | 440/67 |
| 6,183,333 | B1 * | 2/2001 | Hall | 446/154 |
| 6,409,560 | B1 * | 6/2002 | Austin | 441/74 |
| 6,702,634 | B2 * | 3/2004 | Jung | 441/74 |
| 6,793,552 | B2 * | 9/2004 | Derrah | 446/154 |
| 7,207,282 | B1 * | 4/2007 | Ruan et al. | 114/55.56 |
| 7,226,329 | B2 * | 6/2007 | Railey | 441/74 |
| 7,993,178 | B2 * | 8/2011 | Railey | 441/74 |
| 2003/0167991 | A1 * | 9/2003 | Namanny | 114/55.56 |
| 2008/0168937 | A1 * | 7/2008 | Ruan et al. | 114/55.56 |
| 2011/0111650 | A1 * | 5/2011 | Braden et al. | 440/6 |
| 2011/0201238 | A1 * | 8/2011 | Rott et al. | 440/6 |
| 2012/0196494 | A1 * | 8/2012 | Preston | 440/67 |

FOREIGN PATENT DOCUMENTS

| | | |
|---|---|---|
| DE | 3139816 | 5/1983 |
| FR | 2580580 | 10/1986 |
| FR | 2728863 | 7/1996 |
| WO | 2005058685 | 6/2005 |

* cited by examiner

*Primary Examiner* — Lars A Olson
*Assistant Examiner* — Jovon Hayes
(74) *Attorney, Agent, or Firm* — Darren Gardner

(57) ABSTRACT

The invention provides a powered water sports board (10) which includes a motor (16) and a power supply (18), both of which are mounted inside a cavity (20) formed inside an elongate buoyant body (12) of the powered water sports board, and a propeller (36) which is capable of being driven by the motor (16) and which is housed inside a fin (14) of the elongate buoyant body (12) thereby to shield the propeller.

19 Claims, 8 Drawing Sheets

POWERED WATER SPORTS BOARD

FIELD OF THE INVENTION

This invention relates to a powered water sports board and in particular to a powered water sports board which includes one or more fins.

Although the invention may be applied to any type of finned water sports board, for convenience sake it shall be described herein in terms of a powered surf board.

BACKGROUND OF THE INVENTION

It is known to have powered water sports boards including powered surf boards. However, generally the approach to date is not suitable for users that wish to maintain the surfing capability of the board.

Serious and keen surfers and other users of water surf boards may wish to use a surf board in a hydrodynamic way to maximise the use of waves to provide a ride. The development of surfboards therefore has been to focus on design parameters of the board including the material and weight of the board, the length of the board, the shape of the board as well as developments on the shape, position and number of fins mounted on the board. For example, different length and weight boards change the stability and turnability of the board. Changing the shape can also provide a different wave cutting action. However, lately the focus of developments has been on fin designs which have lead to the greatest change or control of the hydrodynamic effect of the board.

For a more recreational user one of the approaches in board design is to provide a water sports board which is merely made suitable to be buoyant with the user on a water body. Such water sports boards may have a large motor attached thereto. The motor therefore provides a major component of the board and consequently could overshadow the board's hydrodynamic functions. This could result in a powered water sports board that has a reduced hydrodynamic capability.

However a concern for the serious surfer can be the amount of energy required to move to a position at which the serious surfer can catch a wave. One factor impacting on the amount of energy consumed is typically the distance which the surfer has to travel from the end of one surf manoeuvre to the start of the next. Another factor is the number of waves which the surfer has to cross in order to get to the wave catching position. One way of reducing the amount of energy consumed is to have a jet-ski rider or even small boat user drag the surfer back through the surf out to the wave catching position. However this requires someone extra to be available for use by the serious surfer. This option can be generally available during competitions. However at recreational surf beaches for safety reasons such vehicles are banned from operating in surfing or swimming areas.

Another option to reduce the energy exerted by a surfer paddling to the wave catching position is to motorise the surf board. However, it will be generally of importance to the serious or keen surfer to not negatively affect the surfability of the board through the mechanisation thereof.

An example of motorised board can be found in US patent application number 2003/167991 which provides a kit for converting a conventional surf board into a motorised surf board. The kit includes an electric motor which is built directly into a rubber or fin. The fin is attachable to the surfboard so that no structural modifications to the board are required in order to incorporate the electric motor into the board. Another example of such a fitment is German patent number 3139816.

These designs suffer from a number of deficiencies including the increased likelihood of a surfer accidentally coming into contact with the rotating propeller. This will be most undesirable. Furthermore, the design could result in a weakening of the fin in order to allow the electric motor to be fitted thereto. The electric motor most likely will also have a short operating period due to the lack of battery storage capacity. An increase of the battery storage capacity could impact negatively on the hydrodynamics of the fin especially when considering how the electrical motor is secured to the fin in the US and German patent matters.

SUMMARY OF THE INVENTION

Accordingly, it is an object of the present invention to at least partly overcome or ameliorate at least one of the disadvantages of the prior art or to provide a useful alternative.

The present invention generally provides a powered water sports board providing a propeller driven surfing device comprising of a buoyant body, a motor and a propeller driven by the motor.

In one embodiment of the invention there is provided for a powered water sports board which includes a motor, a source of power for the motor, an elongate buoyant body having at least one fin; and a propeller driven by the motor and which is capable of propelling the elongate buoyant body; and wherein the motor and the source of power are mounted to the body and the propeller is mounted inside the at least one fin thereby allowing the at least one fin to shield the propeller.

The at least one fin may further be shaped to direct water flow from the propeller to a trailing end of the at least one fin.

The at least one fin may have a leading end and a trailing end; wherein the at least one fin includes a flow passage in which the propeller is mounted; and wherein the flow passage extends through the at least one fin from the leading end to the trailing end.

The flow passage may include an inlet, which faces the leading end, and an outlet which is directed towards the trailing end; and wherein a cross sectional diameter of the flow passage reduces from the inlet to the outlet.

The leading end of the at least one fin may extend across the inlet thereby to reduce a cross sectional diameter of the inlet.

The propeller may be mounted midway inside the flow passage.

The flow passage may be tubular in cross sectional diameter; wherein the fin may extend a portion into the flow passage from the leading end so that the fin divides a first section of the flow passage in half.

The at least one fin may include a portion which extends from the leading end into the flow passage; wherein the portion divides a first section of the flow passage, upstream from the propeller, into half; and wherein the portion has a maximum cross sectional diameter which is less than a maximum cross sectional diameter of a remainder of the fin thereby reducing a volume which is taken up by the portion inside the flow passage.

The flow passage may include an inlet cap on the inlet and an outlet cap on the outlet.

An inlet cap may be fitted to the inlet and an outlet cap may be fitted to the outlet; and wherein each of the inlet and outlet caps is grated to cover the inlet and outlet. At least the inlet cap may have fixed bars which prevent objects finding their way into the flow passage. Each of the inlet and outlet caps may be inserted at least partly into a respective inlet and outlet; and wherein a side wall of the flow passage and each of the inlet and outlet caps include complimentary, inter-engaging formations which allow the inlet and outlet caps to be secured the inlet and the outlet respectively with a tight frictional fit.

The motor may be secured with a mounting to the elongate buoyant body; and wherein the mounting allows water to flow around the motor to cool the motor during operation.

The mounting may include a tubular portion having a front end and a rear end; the front end may include a crosspiece which allows the motor to be secured to the mounting inside the tubular portion; wherein the tubular portion may have an outer sleeve and an inner sleeve which is positioned inside the outer sleeve; wherein the front and rear ends are sealed so that a sealed chamber is formed between the inner and outer sleeves; and wherein the motor is fitted inside the inner sleeve thereby allowing water flowing through the sealed chamber to cool the motor. The tubular portion may include a pair of diametrically opposed flanges which allow the tubular portion to be secured to the elongate buoyant body.

The elongate buoyant body may include a sealed cavity which houses the motor and the source of power.

The cavity may include piping which allows water from a water body on which the elongate buoyant body rests to be directed to the sealed chamber of the mounting to cool the motor.

The sealed chamber may include an entrance, which allows water to be introduced into the sealed chamber, and an exit which allows water to flow from the sealed chamber, and wherein the piping includes a feed portion which allows water to be drawn from the water body to flow into the sealed chamber, and a drain portion which allows water, having circulated around the inner sleeve, to flow from the sealed chamber and to exit the elongate buoyant body.

The elongate buoyant body may include at least one inlet port which allows water to come through an underside of the elongate buoyant body through the feed portion of the piping into the sealed chamber; and wherein the elongate body includes at least one output port which allows water to flow from the sealed chamber through the drain portion; and wherein the inlet and output ports are positioned relative to the motor thereby to allow water to flow into the sealed chamber through the inlet port at a position which is between the motor and a front end of the elongate buoyant body, and from the sealed chamber through the outlet port at a position which is between the motor and a rear end of the elongate buoyant body; whereby the positioning of the inlet and outlet ports allows water to flow through the cooling chamber as the elongate buoyant body moves across a water body.

The inlet may be positioned inside the flow passage downstream from the propeller thereby allowing operation of the propeller to force water into the inlet towards the sealed chamber along the feed portion to cool the motor.

The powered water sports board may include a plurality of motors, a plurality of propellers, and a plurality of fins; and wherein each of the plurality of propellers are mounted to one of the plurality of fins; and wherein the plurality of propellers are driven by the plurality of motors.

In one embodiment of the invention the powered water sports board may include a gearbox which is connected to each of the plurality of propellers; and wherein the plurality of motors are connected in series to drive the gearbox.

The powered water sports board may include an acceleration switch which is mounted midway to the elongate buoyant body for access from the upper side; and wherein activation of the acceleration switch causes operation of the motor thereby to cause rotational in the propeller.

Activation of the acceleration switch may cause the propeller to rotate at a maximum velocity.

In a further embodiment of the invention there is provided for a powered water sports board which includes a motor, a power supply, a propeller driven by the motor; and an elongate buoyant body having at least one fin; wherein the motor and the power supply are mounted to the body and the propeller is mounted to the at least one fin; and wherein the at least one fin includes a flow passage in which the propeller is housed.

The flow passage may be adapted to focus the flow of water from the propeller.

In one form of the invention there is provided a motorised surfboard having a hydrodynamically constructed board and fins suitable for allowing the user to surf unaided by the motor; one or more motors connected to a source of power and powering one or more propellers; wherein the one or more motors, propellers and source of power are sized and located on the board to provide little reduction in the unaided hydrodynamic surfability of the board.

The one or more motors and power supplies can be located within the hydrodynamic form of the surfboard. The surfboard can include cavities for receiving the one or more motors and power supplies and which allows accessibility.

The at least one fin has a hydrodynamic shape with a leading front edge and a rear edge and a flow passage housing includes a open shroud form enclosing the propeller and with an front opening leading to a rear opening whereby water enters from the front opening and exits via a second smaller opening producing thrust.

The flow passage can be located at the base of the fin adjacent the underside of the board.

The invention also provides a lightweight motorised surfboard comprising:

- a lightweight hydrodynamic body
- at least one fin;
- a battery operated motor;
- a 2 blade to 8 blade propeller whereby the propeller is incorporated into the structure of at least one of the fins; and
- a flow passage housing the fin structure incorporating the propeller and mounted under the body of the board, the flow passage housing having an encircling body able to substantially encircle the propeller and with a first front opening leading to a rear second smaller opening whereby in operation water enters from the front opening and exits via the second smaller opening producing thrust.

BRIEF DESCRIPTION OF THE DRAWINGS

In order that the invention can be more readily understood the invention is further described by way of example with reference to the accompanying drawings.

DESCRIPTION OF ILLUSTRATED EMBODIMENTS OF THE INVENTION

Figure 1:
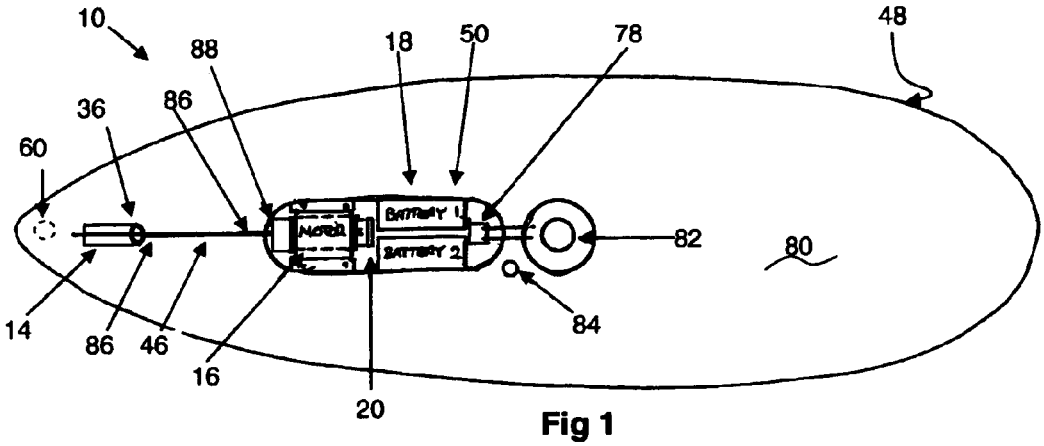
FIG. 1 is a schematic illustration of a powered water sports board according to the invention.

FIG. 1 of the accompanying representations illustrates a powered water sports board 10 according to the invention. The powered water sports board includes an elongate buoyant body 12 carrying at least one fin 14 (illustrate in greater detail in FIGS. 2 to 4), a motor 16 and a source of power 18 for the motor both of which are mounted inside a cavity 20 and into the elongate buoyant body 12. In the illustrated embodiment the source of power 18 is shown as being a number of electrical batteries and the motor 16 is listed as being an electrical motor which is electrically connected to the batteries.

Figure 2:
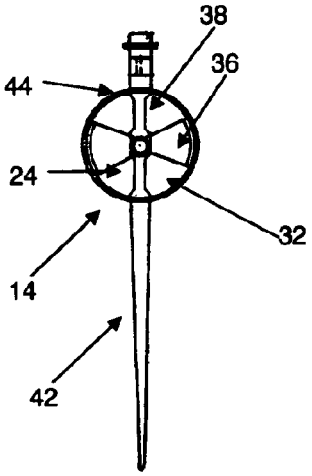
FIG. 2 is a schematic illustration from a rear end of a fin used in the powered water sports board and to which a propeller is mounted.
Figure 3:
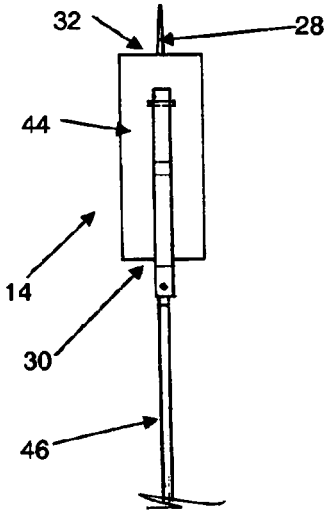
FIG. 3 is a schematic illustration in plan of the fin of FIG. 2.
Figure 4:
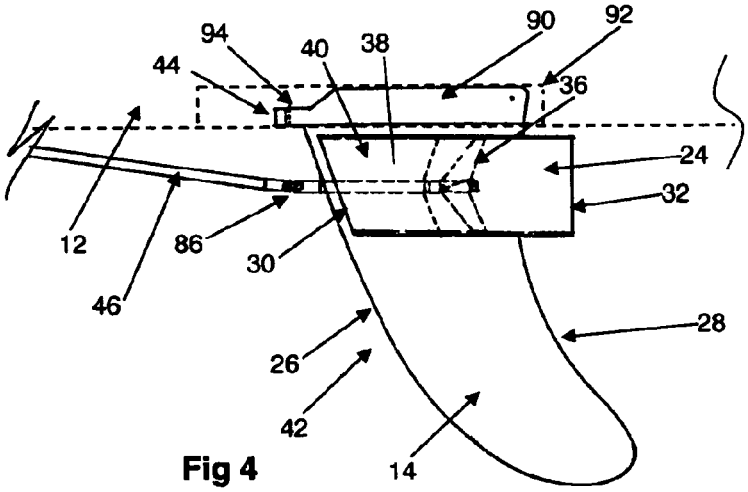
FIG. 4 is a schematic illustration from one side of the fin of FIG. 2.

Referring in particular to FIGS. 2 to 4, the fin 14 contains a flow passage 24 which extends through the fin from a leading end 26 to a trailing end 28 of the fin. The flow passage has an inlet 30 and an outlet 32. Mounted inside the flow passage is a propeller 36 which is connected to the motor 16 the operation of which causes rotational movement in the propeller. As best can be seen in FIGS. 2 and 3, the flow passage has a tubular profile.

Referring back to FIG. 4, the propeller 36 is mounted midway inside the flow passage 24. This allows a portion 38 of the fin 14 to extend from the leading edge into 26 into the flow passage. The portion 38 therefore divides a first section 40 of the flow passage in half. The portion 38 increases the strength of the fin by providing a direct connection between an upper portion 42 of the fin with a base portion 44 thereof. Furthermore, the portion increases the surface area of the fin and may reduce the turbulence with which water flows into the flow passage 24. Referring to FIG. 2, the portion 38 has a reduced maximum cross sectional diameter when compared with a maximum cross sectional diameter of the remaining portion of the fin. This increases the volume of water which can pass through the flow passage through the inlet 30.

Returning to FIG. 1, the propeller 36 is connected to the motor 16 with a shaft 46 which extends from an underside 48 of the elongate buoyant body 12 into the cavity 20. The cavity is a dry chamber 50 and is sealed at an upper end 52, see FIG. 14, with a lid 56 which is shown in FIG. 15. The motor and batteries 18 are housed in the dry chamber 50 thereby reducing the likelihood of these components being damaged by water.

Figure 13:
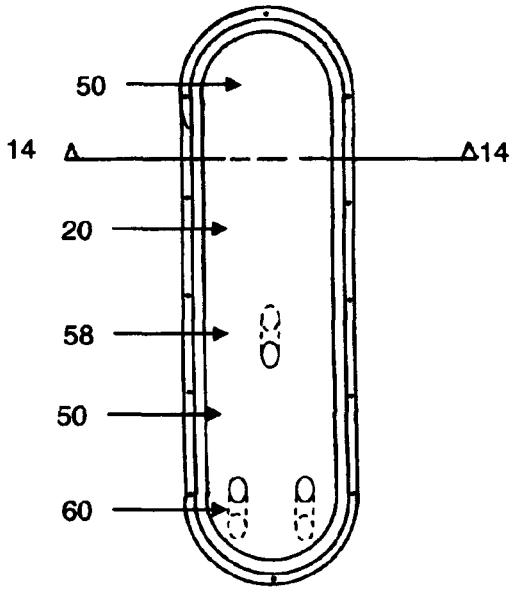
FIG. 13 is a schematic illustration of a cavity of the powered water sports board according to the invention.
Figure 14:
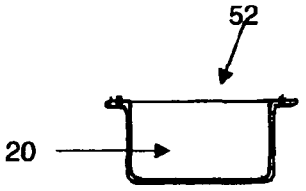
FIG. 14 is a schematic illustration in cross-section of the cavity taken on a line 14-14 in FIG. 13.
Figure 15:
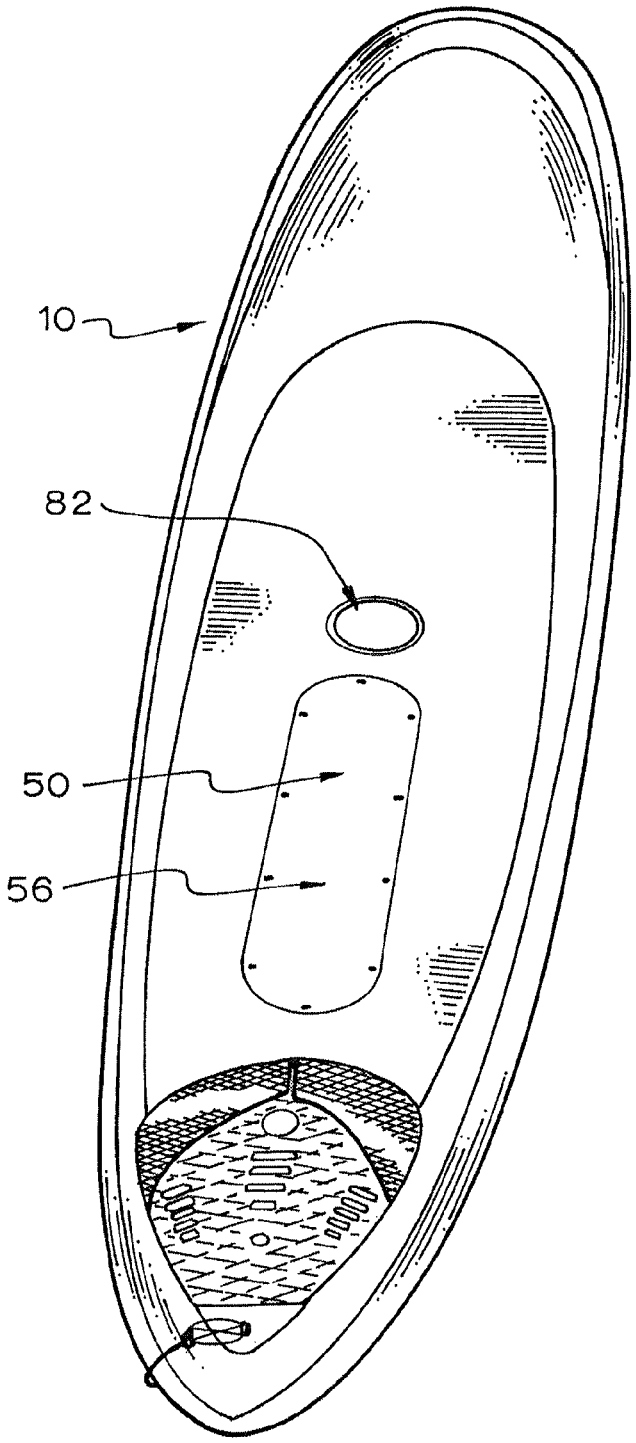
FIG. 15 is a photographic representation of the powered water sports board illustrated in FIG. 1.
Figure 20:
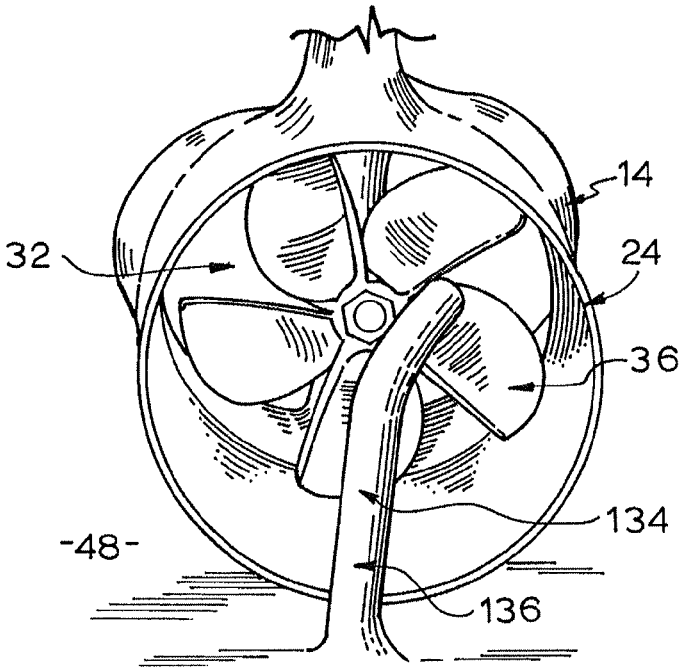
FIG. 20 is a schematic illustration of the one inlet port is positioned downstream from the propeller.

The cavity 20 is further illustrated in FIGS. 13 and 14. The cavity is associated with one or more inlet ports 58 and with one or more outlet ports 60. In FIG. 20, one inlet port is positioned downstream from the propeller 36. Thus, operation of the propeller forces water into the inlet. The one inlet port is typically positioned in this manner when the powered water sports board 10 contains a motor 16 which has a relatively small power rating. In such a situation the powered water sports board 10 will not be able to move at great speed over a water body which is generally required to push water with sufficient pressure into the inlet.

Figure 21:
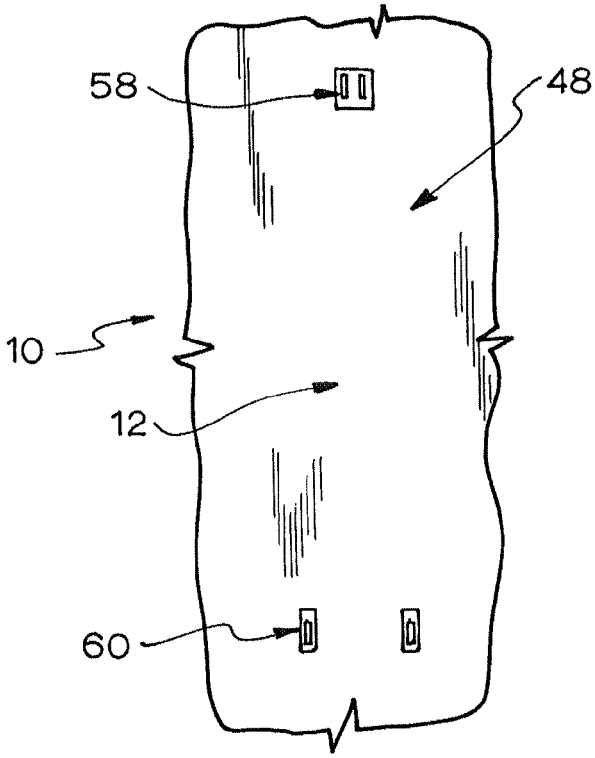
FIG. 21 is a schematic illustration of the two inlet ports shown to be positioned on an underside of the elongate buoyant body.

In FIG. 21 two inlet ports are shown to be positioned on an underside 48 of the elongate buoyant body 12. This configuration is typically adopted in powered water sports boards 10 which contain a high powered motor 16. Thus, the high powered motor 16 is capable of pushing the elongate buoyant body 12 over a body of water with sufficient speed to cause water to be pushed into the two inlet ports with sufficient pressure.

FIG. 1 illustrates that one outlet port 60 is positioned on an underside 48 of the elongate buoyant body 12 in proximity to a rear end of the elongate buoyant body.

Referring in particular to FIGS. 1 and 10 to 12, the motor 16 is secured with a mounting 62 to the elongate buoyant body 12 inside the dry chamber 50. The mounting includes a tubular portion 64 which has a front end 66 (shown in FIG. 11) and a rear end 68 shown in FIG. 12. The tubular portion includes a pair of spaced apart, diametrically opposed flanges 70 with which the tubular portion is secured to the elongate buoyant body with a number of fasteners, not shown. The front end has a cross piece 72 which allows the motor 16 to be secured to the tubular section 64 using a number of fasteners, not shown, through a number of apertures 74. The cross piece further includes a central aperture 76 which allows an axle to extend through the cross piece. Wiring, extending from the power supply 18, is connected through the rear end to the motor 16.

The motor 16 is either a brushed or brushless which typically is designed to deliver a high torque. The power rating of the motor typically ranges between 100 to 8000 Watts. A motor with a higher power rating is generally used for higher speed boards as typically such a motor can run at high speeds of around 20,000 RPM or higher. A motor with the lower power rating is generally used with boards which are not required to be propelled with high-speed through water. Typically such a lower power rating motor run at speeds of around 5000 RPM or lower.

As mentioned hereinabove, the power supply 18 is a form of one or more batteries which provide power to the motor 16. Typically these one or more batteries are housed inside the dry chamber 50 thereby reducing the likelihood of a short-circuit occurring. Also mounted inside the dry chamber are other control componentry 78 such as a switch with a relay which is used to operate the supply of electricity from the power supply 18 to the vehicle motor 16. The control componentry, for a brushless motor, also includes speed controllers and other required componentry in order to operate the brushless motor.

Referring back to FIG. 1, accessible from an upper side and 80 of the elongate buoyant body 12 is a throttle or acceleration switch 82. A user of the powered water sports board 10, not shown, can use the acceleration switch to cause the motor to speed up to operate at maximum revolutions, for example 20,000 RPM. Also accessible from the other side 80 is a charge jack 84 which allows the power supply 18 to be charged from a suitable power source such as mains. The acceleration switch may be in the form of an open switch which is closed when operated by a user. The closing of the switch complete an electrical circuit thereby allowing electricity from the power supply 18 to flow to the motor 16.

The shaft 46 includes a number of universal joints 86 which allow the shaft to be connected at one end to the propeller 36 and at an opposed end to the motor 16. In such a configuration the universal joints connect a number of rigid shaft sections in order to form the shaft 46. However, one or more of the rigid shaft sections may be flexible so that the universal joints are no longer required. This will therefore allow a rigid shaft section, to which the propeller is secured, to be connected to the motor 16 with a flexible shaft. Thus, the flexible shaft is capable of bending through the elongate buoyant body 12 to connect the propeller to the motor 16.

Figure 9:
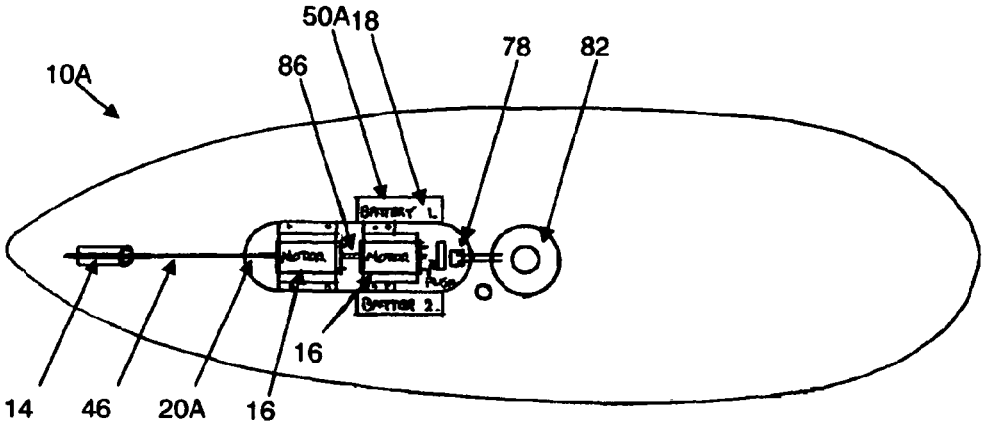
FIG. 9 is a schematic illustration of a powered water sports board according to a variation of the invention.
Figure 18:
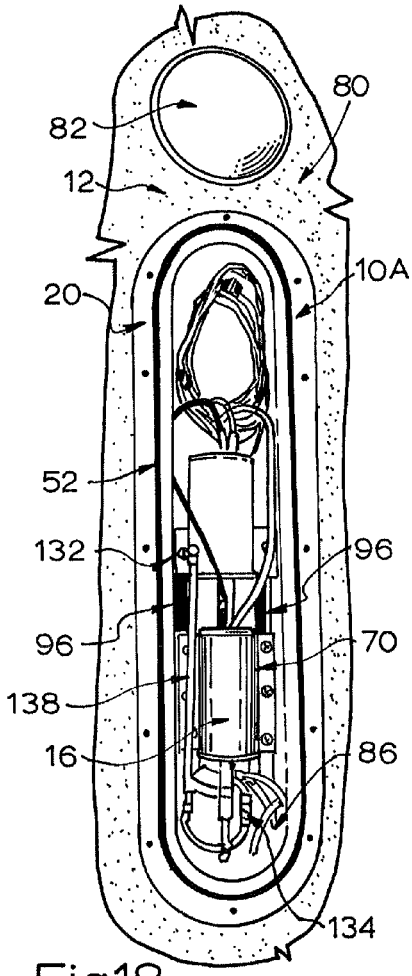
Figure 19:
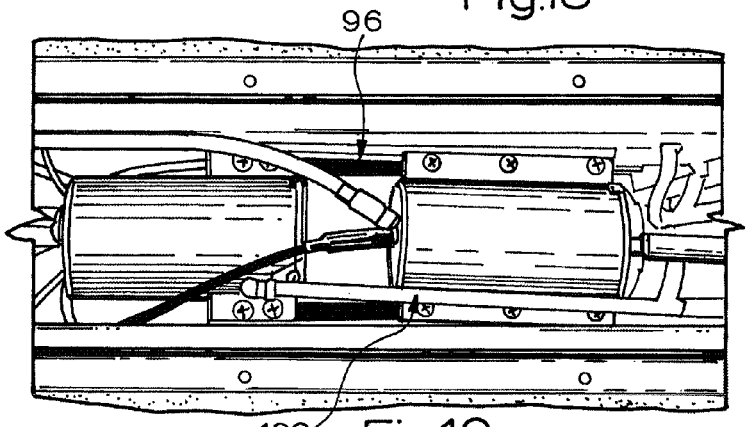

FIGS. 9, 18 and 19 illustrate a variation 10A of the powered water sports board according to the invention. Like reference numerals are used to designate like components between the powered water sports boards 10 and 10A.

Figure 6:
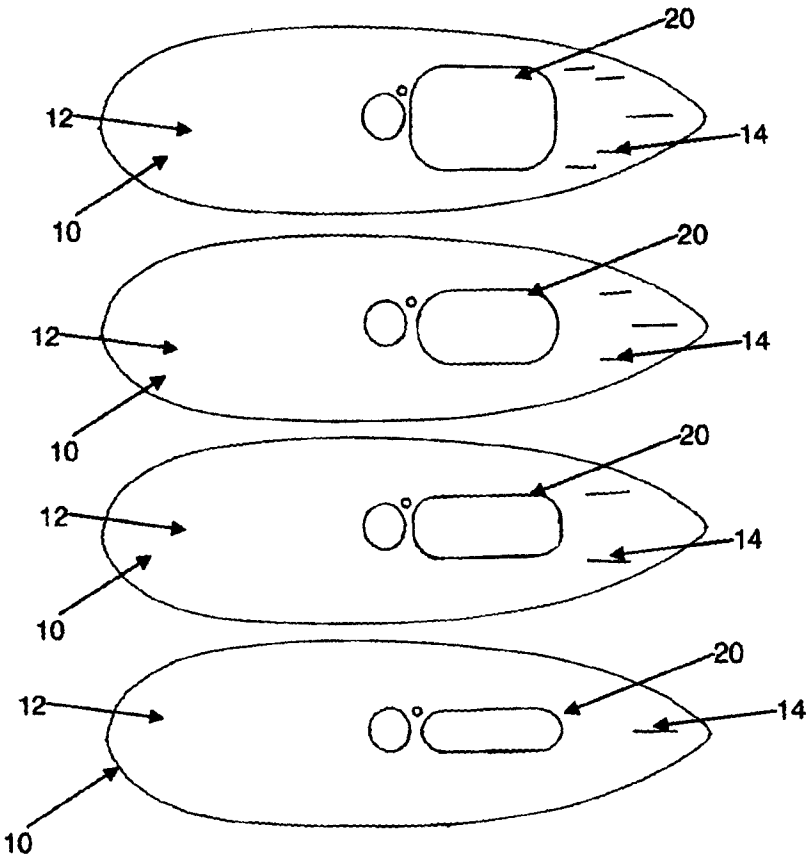
FIG. 6 is schematic illustrations showing in plan a number of different powered water sports boards according to the invention wherein each board has a different sized cavity.

The powered water sports board 10A includes two motors 16 which are connected in series. This allows motor is having lower power ratings to be used in unison in order to achieve an equal or an improved power rating when compared to a larger motor. Consequently, dimensions of the cavity 20A can be reduced as smaller motors are used as opposed to one or more large motors. Nonetheless, as is shown in FIG. 6, the dimensional of the cavity are adjusted according to the number and sizes of the motors 16 used in the construction of the powered water sports board 10. For example, when the powered water sports board includes five fins 14, more motors 16 may be required in order to drive the propellers. Accordingly, the dimensions of the cavity 20 are increased to accommodate the motors 16 and batteries 18 required to power the motors.

Figure 5:
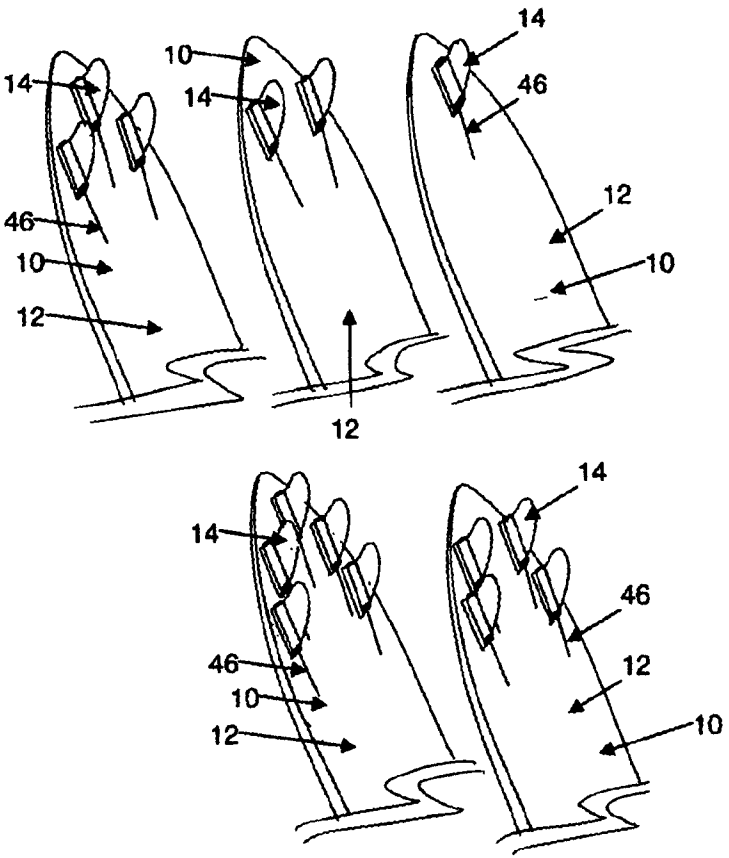
FIG. 5 is schematic illustrations showing in perspective a number of different powered water sports boards according to the invention wherein each board has a different fin configuration.

FIG. 5 illustrates that the invention can be used on a surfboard having any number of fins. Depending on requirements such as availability of space in the elongate buoyant body 12 and power rating, one motor 16 can be used to drive a number of propellers 14 through a gearbox 88 (see FIG. 1). Alternatively, each propeller can be connected to an individual motor which will typically increase the dimensions of the cavity 20.

The fin 14 of FIG. 4 is shown having an attachment bracket 90 integrally formed with the fin thereby allowing the fin to be secured to a fin box 92 which is shown schematically in FIG. 4. The attachment bracket is dimensioned to allow the position of the fin relative to the elongate buoyant body 12 to be slidingly adjusted along the fin box 92. A pin 94 is used to secure the fin to the elongate buoyant body once the correct position is selected. However, it should be noted that the fin can also be integrally formed with the elongate buoyant body thereby not needing the attachment bracket. The invention is therefore not limited in this regard.

Figure 10:
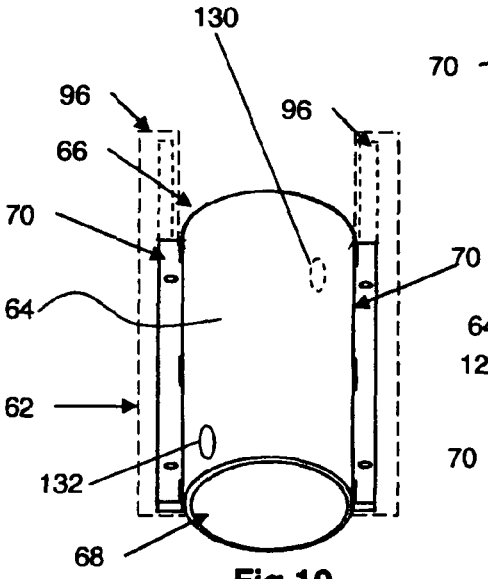
FIG. 10 is a schematic illustration in perspective of a mounting used in the powered water sports board according to the invention.
Figure 11:
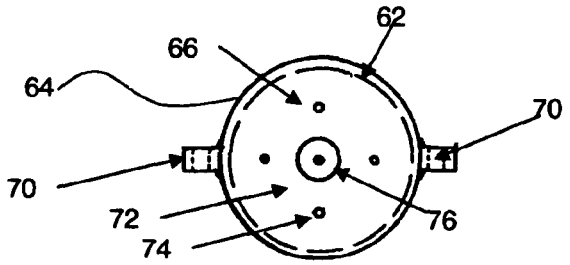
FIG. 11 is a schematic illustration from a front end of the mounting of FIG. 10.
Figure 12:
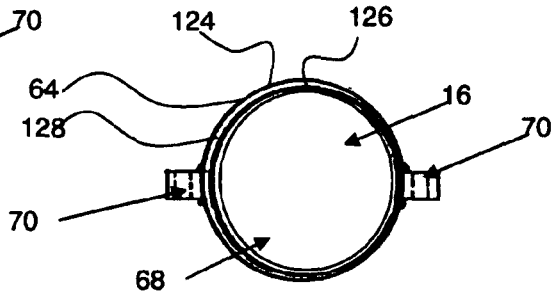
FIG. 12 is a schematic illustration from a rear end of the mounting of FIG. 10.

Referring in particular to FIGS. 1, 4 and 10, the motor 16 is secured with the shaft 46 to the propeller 36. The flanges 70 are mounted to a rail 96, shown schematically in FIG. 10, which in turn is mounted to the dry chamber 50. The rail allows the mounting 62 to slide inside the dry chamber thereby to accommodate the sliding movement of the fin 14 relative to the elongate buoyant body 12. However, the rail will be discarded when the fin is fixed to the elongate buoyant body. The invention is therefore not limited in this regard.

Figure 8:
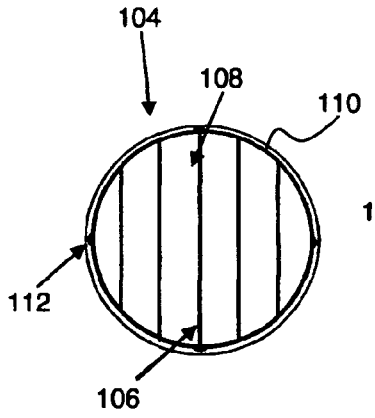
FIG. 8 is a schematic illustration of the outlet cap.
Figure 7:
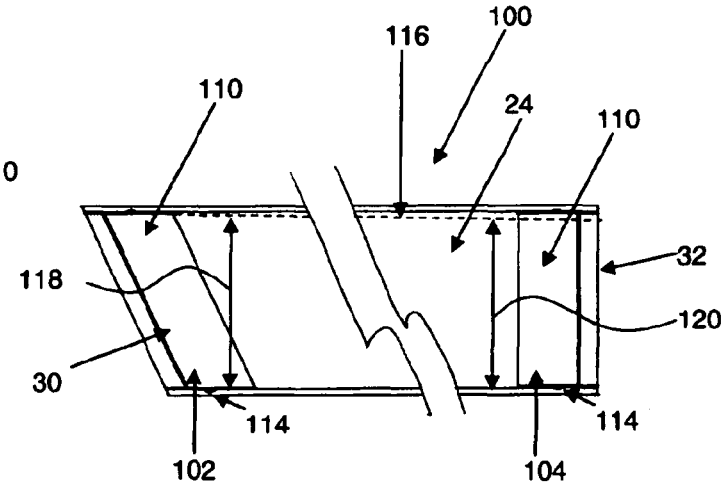
FIG. 7 is a schematic illustration of a flow passage of a fin of the powered water sports board and to which inlet and outlet caps are fitted.

FIG. 7 shows a variation 100 of the flow passage according to the invention. Like reference numerals are used to designate like components. An outlet 30 of the flow passage 100 extends past a leading end 26 of a fin 14. Due to the likelihood of unwanted objects moving into the flow passage 100, the inlet 30 is covered with an inlet cap 102 and the outlet 32 is covered with an outlet cap 104. As an example of the construction of the inlet and outlet caps, the construction of the outlet cap 104 is further described in FIG. 8.

The outlet cap 104 includes a number of rods 106 which extends across a central aperture 108 of the outlet cap. A flange 110 of the outlet cap carries a number of spigots 112 which are registered with counterpart sockets 114 formed into an inner side or side wall 116. This allows the outlet cap to be fitted to the outlet 32 so that the flange 110 extends at least partly into the flow passage 100. It should be noted that where the outlet would 30 is positioned behind the leading end 26 (4 example is shown in FIG. 4), that the portion 38 extending across the inlet will perform the same function as the rods 106. As such the inlet cap 102 is not needed.

The flow passage 100 may also be profiled to have a conical shape so that the inlet 30 has a maximum cross sectional diameter 118 which is greater than a maximum cross sectional diameter 120 of the outlet 32.

The housing of the propeller 14 inside flow passages 24 and 100 of the fin 14 has a number of advantages. The positioning of the propeller inside the fin allows the fin to shield the fin thereby reducing the likelihood of the propeller inadvertently coming into contact with objects such as a fish, sand, fingers or toes. The flow passage provides a mechanism for focusing water being accelerated through operation of the propeller. This focus increases the thrust capable of being generated through operation of the propeller. The profiling of the flow passage 100, which typically has a reduction in size in the order of 10% between the maximum cross sectional diameters 118 and 120 respectively of the inlet 30 and the outlet 32, is aimed to provide further focusing of the water flow from the propeller.

Furthermore, the positioning of the portion 38 of the fin 14 inside the first section 40 of the flow passages 24 and 100 allows the surface area of the fin to be increased. As described hereinabove, the upper portion or blade portion 42 extends from the base portion 44. Accordingly, the inclusion of the portion 38 inside the flow passage 24 effectively serves to extend the blade portion 42. As such the portion 38 increases the surface area to the blade portion 42 thereby to increase lateral stability capable of being provided by the fin when cutting through a body of water.

Additionally, the propeller 36 is positioned midway inside the flow passage 24 thereby reducing the likelihood of an object, for example a finger, coming into contact with the propeller. Also, the use of the inlet and outlet caps 102 and 104 further reduces the likelihood of such an object finding its way into the flow passage and coming into contact with the propeller.

Referring in particular to Figured 10 and 12, the tubular portion 64 includes an outer sleeve 124 and an inner sleeve 126 which is fitted to the outer sleeve. The front and rear ends 66 and 68 of the tubular portion 64 are sealed thereby creating a sealed chamber 128 between the inner and outer sleeves. The tubular portion further includes an entrance 130 and an exit 132. The entrance and the exit are spaced from one another thereby forcing water introduced into the sealed chamber through the entrance to flow over and along the inner sleeve 126 in order to reach the exit 132. The inner sleeve is dimensioned in order to allow the motor 16 to be inserted into the inner sleeve with a close fit. This close fit will promote the absorption of heat, generated through the operation of the motor, by water passing through the sealed chamber 82.

The one or more outlet ports 60 are also spaced from the one or more inlet ports 58. This requires water having entered the calling chamber through the inlet ports to flow through the cooling chamber before being able to exit the cooling chamber through the outlet ports 58. Furthermore, the inlet ports are designed to facilitate and promote the flow of water into the cooling chamber as the elongate buoyant body moves across a water body, for example the sea. Thus, movement of the elongate buoyant body through water body result in water being pushed into the cooling chamber. This water will be pushed from the cooling chamber through the outlet ports 60 by the continuous movement of more water, source from the water body, through the inlet ports.

Figure 17:
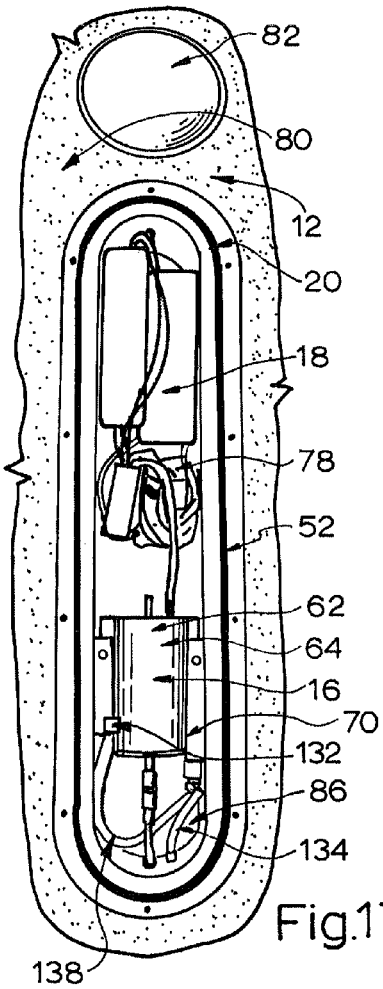
FIG. 17 to FIG. 19 is a schematic illustration of the powered water sports boards that includes piping which has a feed portion and a drain portion. The feed portion is connected at one end to the one or more inlet ports and at an opposed end to the inlet.

Referring in particular to FIGS. 17 to 19, the powered water sports boards 10 and 10A include piping 134 which has a feed portion 136 and a drain portion 138. The feed portion is connected at one end to the one or more inlet ports 58 and at an opposed end to the inlet 84. Similarly, the drain portion is connected at one end to the one or more outlet ports 60 and at an opposed end to the exit 86. Thus, water enters the feed portion through the one or more inlet ports and is passed into the sealed chamber 128 through the inlet 84. After the water has passed through the sealed chamber over the inner sleeve 126, the water exits the elongate buoyant body 12 from the one or more outlet ports 60 through the drain piping.

Figure 16:
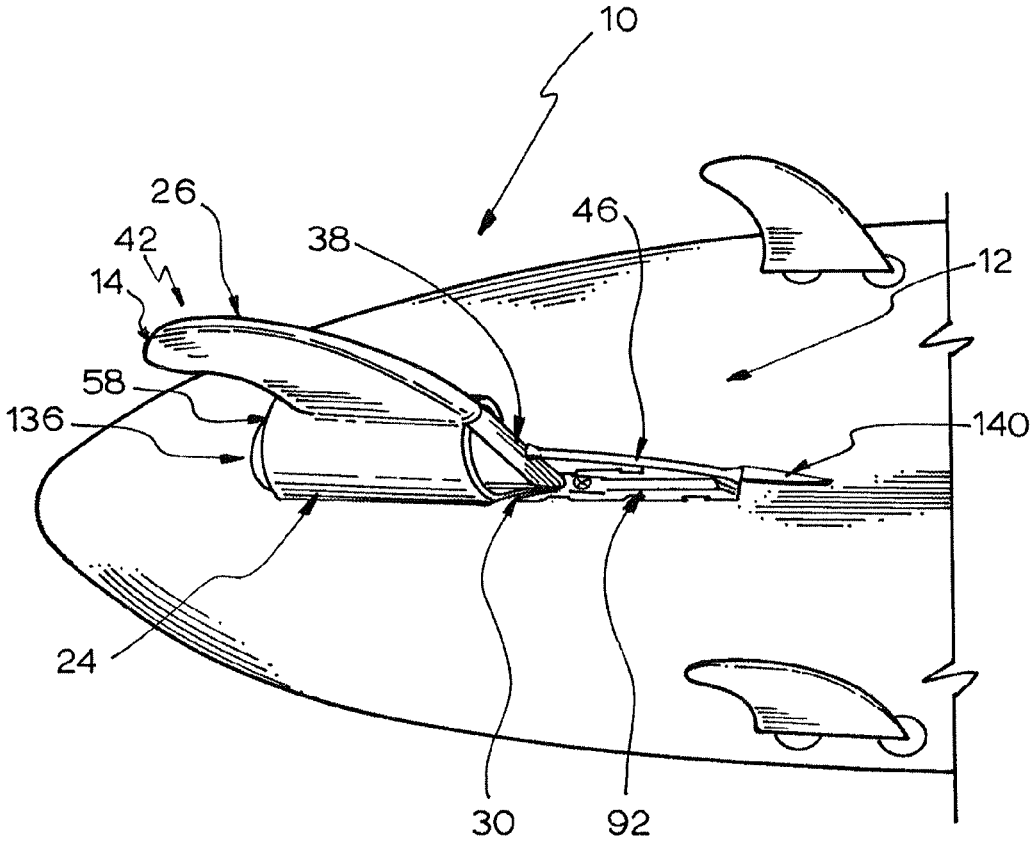
FIG. 16 is a schematic illustration of the shaft extending from the gearbox through the elongate buoyant body in a sleeve.

Referring in particular to FIG. 16, the shaft 46 extends from the gearbox 88 through the elongate buoyant body 12 in a sleeve 140. The sleeve is sealed using, for example, silicone, rubber o-rings, a water impervious bearing, or grease which is force-fed into the sleeve through a grease nipple.

The invention provides a water sports board which is capable of being propelled across a water body using a propeller, which is operated with a motor and power supply which is housed inside a cavity formed inside the elongate buoyant body, and which is shielded inside a fin of the elongate buoyant body. The propeller is housed inside a flow passage extending through the fin which allows water exonerated through the operation of the propeller to be focused towards a trailing end of the fin. The focusing of the water is caused by the propeller pushing the accelerated water along the flow passage and exits from an outlet of the flow passage in proximity to the trailing end of the fin. Furthermore, thrust generated by the propeller can be used to force water through a sealed chamber thereby allowing the sealed chamber to be called by the water.

While we have described herein a particular embodiment of a powered water sports board, it is further envisaged that other embodiments of the invention could exhibit any number and combination of any one of the features previously described. However, it is to be understood that any variations and modifications which can be made without departing from the spirit and scope thereof are included within the scope of this invention.

Any reference to publications in this specification is not an admission that the disclosures constitute common general knowledge in Australia.

The claims defining the invention are as follows:

1. A powered water sports board, the powered water sports board comprising;

an elongate buoyant body, the elongate buoyant body comprising a sealed cavity having a motor and a source of power for the motor mounted inside the sealed cavity; and at least one fin connected to the elongate buoyant body, the fin having a leading end and a trailing end and a flow passage which extends through the at least one fin from the leading end to the trailing end, the flow passage comprising a propeller mounted inside the flow passage midway between the leading end and the trailing end of the fin, the propeller being driven by the motor and being capable of propelling the elongate buoyant body.

2. The powered water sports board according to claim 1 wherein the flow passage includes an inlet, which faces the leading end of the fin, and an outlet which is directed towards the trailing end of the fin; and wherein a cross sectional diameter of the flow passage reduces from the inlet to the outlet thereby allowing the at least one fin to direct water flow from the propeller to a trailing end of the at least one fin.

3. The powered water sports board according to claim 2 wherein the inlet is displaced from the leading end of the fin; and wherein the leading end of the at least one fin extends across the inlet thereby to reduce a cross sectional diameter of the inlet.

4. The powered water sports board according to claim 1 wherein the flow passage is tubular in cross sectional diameter; and wherein the at least one fin includes a portion which extends at least partly into the flow passage from the leading end so that the at least one fin divides a first section of the flow passage, between the propeller and the leading end, in half.

5. The powered water sports board according to claim 2 wherein an inlet cap is fitted to the inlet and an outlet cap is fitted to the outlet and wherein each of the inlet and outlet caps is grated to cover the inlet and outlet.

6. The powered water sports board according to claim 5 wherein each of the inlet and outlet caps is inserted at least partly into a respective inlet and outlet; and wherein a side wall of the flow passage and each of the inlet and outlet caps include complementary, inter-engaging formations which allow the inlet and outlet caps to be secured to the inlet and the outlet respectively with a tight frictional fit.

7. The powered water sports board according to claim 1 wherein the motor is secured with a mounting to the elongate buoyant body; and wherein the mounting allows water to flow around the motor to cool the motor during operation.

8. The powered water sports board according to claim 7 wherein the mounting includes a tubular portion having a front end and a rear end; the front end includes a crosspiece which allows the motor to be secured to the mounting inside the tubular portion; wherein the tubular portion has an outer sleeve and an inner sleeve which is positioned inside the outer sleeve; wherein the front and rear ends are sealed so that a sealed chamber is formed between the inner and outer sleeves; and wherein the motor is fitted inside the inner sleeve thereby allowing water flowing through the sealed chamber to cool the motor.

9. The powered water sports board according to claim 7 wherein the tubular portion includes a pair of diametrically opposed flanges which allow the tubular portion to be secured to the elongate buoyant body.

10. The powered water sports board according to claim 9 wherein the flanges are secured to railings thereby allowing longitudinal movement of the motor relative to the elongate buoyant body to accommodate pivotal movement of the at least one fin relative to the elongate buoyant body.

11. The powered water sports board according to claim 1 wherein the cavity includes piping which allows water from a water body, on which the elongate buoyant body during use rests, to be directed to the sealed chamber of the mounting to cool the motor.

12. A powered water sports board according to claim 11 wherein the sealed chamber includes an entrance, which allows water to be introduced into the sealed chamber, and an exit which allows water to flow from the sealed chamber, and wherein the piping includes a feed portion which allows water to be drawn from the water body into the sealed chamber, and a drain portion which allows water, having circulated around the inner sleeve, to flow from the sealed chamber and to exit the elongate buoyant body.

13. The powered water sports board according to claim 12 wherein the elongate buoyant body includes at least one inlet port which allows water to come through an underside of the elongate buoyant body through the feed portion of the piping into the sealed chamber; and wherein the elongate body includes at least one output port which allows water to flow from the sealed chamber through the drain portion.

14. The powered water sports board according to claim 13 wherein the inlet and output ports are positioned relative to the motor thereby to allow water to flow into the sealed chamber through the inlet port at a position which is between the motor and a front end of the elongate buoyant body, and from the sealed chamber through the outlet port at a position which is between the motor and a rear end of the elongate buoyant body; whereby the positioning of the inlet and outlet ports allows water to flow through the sealed chamber as the elongate buoyant body moves across the water body.

15. A powered water sports board according to claim 13 wherein the inlet port is positioned inside the flow passage downstream from the propeller thereby allowing operation of the propeller to force water into the inlet port towards the sealed chamber along the feed portion to cool the motor.

16. The powered water sports board according to any one of claims 1 which includes a plurality of motors, a plurality of propellers, and a plurality of fins; and wherein each of the plurality of propellers are mounted to one of the plurality of fins; and wherein the plurality of propellers are driven by the plurality of motors.

17. The powered water sports board according to claim 16 which includes a gearbox which is connected to each of the plurality of propellers; and wherein the plurality of motors are connected in series to drive the gearbox.

18. The powered water sports board according to any one of claims 1 which includes an acceleration switch which is mounted midway to the elongate buoyant body for access from an upper side of the elongate buoyant body; and wherein activation of the acceleration switch causes the propeller to rotate at a maximum velocity.

19. A powered water sports board which includes an elongate buoyant body comprising at least one fin; a sealed cavity having a motor and a power supply; and, a propeller driven by the motor; wherein the propeller is mounted to the at least one fin; and the at least one fin includes a tubular flow passage in which the propeller is mounted inside the flow passage between the leading end and the trailing end of the fin; the tubular flow passage collects in use water adjacent a leading end of the at least one fin and focuses the collected water onto the propeller.

* * * * *